United States Patent [19]

Matsui et al.

[11] 4,240,247

[45] Dec. 23, 1980

[54] SPLICED JOINT OF SPUN YARN AND METHOD FOR PRODUCING SAME

[75] Inventors: Isamu Matsui; Shigeru Takasaki, both of Kyotoshi; Hiroshi Mima, Joyoshi, all of Japan

[73] Assignee: Murata Kikai Kabushiki Kaisha, Japan

[21] Appl. No.: 973,176

[22] Filed: Dec. 26, 1978

[30] Foreign Application Priority Data

| | | | |
|---|---|---|---|
| Dec. 28, 1977 | [JP] | Japan | 52-158392 |
| Jan. 7, 1978 | [JP] | Japan | 53-678 |
| Feb. 1, 1978 | [JP] | Japan | 53-10776 |

[51] Int. Cl.[3] ..... D01H 15/00

[52] U.S. Cl. ..... 57/202; 57/22

[58] Field of Search ..... 57/22, 202

[56] References Cited

U.S. PATENT DOCUMENTS

| | | | |
|---|---|---|---|
| 3,379,002 | 4/1968 | Rosenstein | 57/202 |
| 3,570,236 | 3/1971 | Arguelles | 57/202 |
| 4,002,012 | 1/1977 | Norris et al. | 57/22 |

*Primary Examiner*—Donald Watkins

*Attorney, Agent, or Firm*—Whittemore, Hulbert & Belknap

[57] ABSTRACT

Broken ends of a spun yarn are introduced into a hole of an air nozzle device from upper end and lower end of the hole respectively and the yarns are doubled. The doubled yarns are slightly slacked and subjected to air jetting by the air nozzle device to produce a spliced joint. The distribution of twists inherent of spun yarns is changed in the region of the spliced joint by twists imparted to the yarns by the air jet nozzle and at least one fixed portion of the new twist distribution is formed in the spliced joint.

10 Claims, 11 Drawing Figures

SPLICED JOINT OF SPUN YARN AND METHOD FOR PRODUCING SAME

FIELD OF THE INVENTION

The present invention relates to a yarn splicing method using an air nozzle knotter and more particularly it relates to a method comprising introducing ends of two spun yarns into an air nozzle and subjecting the yarn ends to the action of a swirling air stream. According to the method of the present invention, a high quality spliced joint of the spun yarn can be obtained.

The present invention further relates to a spliced joint of the spun yarn having a new constitution in twists.

DESCRIPTION OF THE PRIOR ART

As the conventional method for forming tying joints in spun yarns, there are known a method using a Fisherman's knotter and a method using a Weaver's knotter and fastening tying joints by using a paste. According to the method using a Fisherman's knotter, spun yarns are bent in various directions for formation of tying joints and no consideration is paid to the change of twists on spun yarns. The joints are fastened by binding the yarns tightly to each other, and the strength of the tying joint is determined by this binding strength relatively to the size of yarn ends projecting from the joint and the inherent strength of the yarns. Accordingly, adjustment of the strength of the tying joint is very delicate and difficult. Ordinarily, the size of the joint or knot is about 3 times the size of the spun yarn. Further, at the winding step, a time is required for one rotation of a mechanical knotter bill. According to the latter method using a Weaver's knotter, spun yarns are kept in parallel to each other and change of twists is not taken into account. The joints are fastened by binding yarns by using a quick-drying paste, and in this method, it is important how quickly the applied paste is dried at the winding step.

These known methods, especially the former method, have been practised for a long time in textile industries, and development of novel typing joints has not been tried and novel tying joins as claimed in the present invention have not been proposed.

SUMMARY OF THE INVENTION

It is an object of the present invention to provide a novel spliced joint where two spun yarns are pieced up together.

It is another object of the present invention to provide a high quality spliced yarn having smaller size of joints.

It is further object of the present invention to provide a yarn splicing method using an air nozzle, comprising introducing ends of two spun yarns into the nozzle and subjecting the yarn ends to the action of a swirling air stream formed by jetting air from the air nozzle.

It is still further object of the present invention to provide a yarn splicing method for producing the spliced spun yarn decreasing a yarn breakage in the knitting or weaving steps which the spliced yarn is processed.

Other and further objects, features and advantages of the invention will appear more fully from the following description.

DETAILED DESCRIPTION OF PREFERRED EMBODIMENTS

Figure 1:
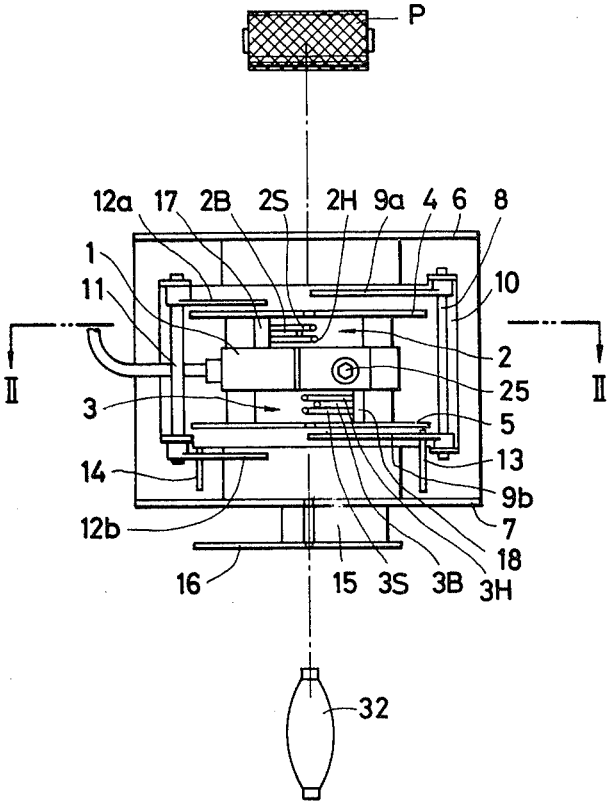
FIG. 1 is a front view illustrating one embodiment of the apparatus in practising the method of the present invention.

The present invention will now be described in detail by reference to the accompanying drawings.

At first, one method of the present invention is illustrated referring to FIGS. 1 to 4.

Reference numeral 1 represents an air swirling nozzle, and knotter bills 2 and 3 are disposed above and below the nozzle 1 and yarn guide plates 4 and 5 are disposed above and below the bills 2 and 3. Another yarn guide plates 6 and 7 are disposed above and below said yarn guide plates 4 and 5. Yarn pressers 9*a* and 9*b* turnably supported on a frame 10 by a shaft 8 and yarn pressers 12*a* and 12*b* turnably supported on the frame 10 by a shaft 11 are disposed between the yarn guide plates 4 and 6 and between the yarn guide plates 5 and 7. The yarn pressers 9*a* and 9*b* are turned through a rod 13 by a knotter cam (not shown) and the yarn pressers 12*a* and 12*b* are turned through a rod 14 by the knotter cam respectively.

An electronic slub catcher 15 is fixed to the lower face of the yarn guide plate 7, and a yarn guide plate 16 is fixed to the lower face of the electronic slub catcher. Reference symbols P and 32 represent a package and a cop, respectively.

Figure 2:
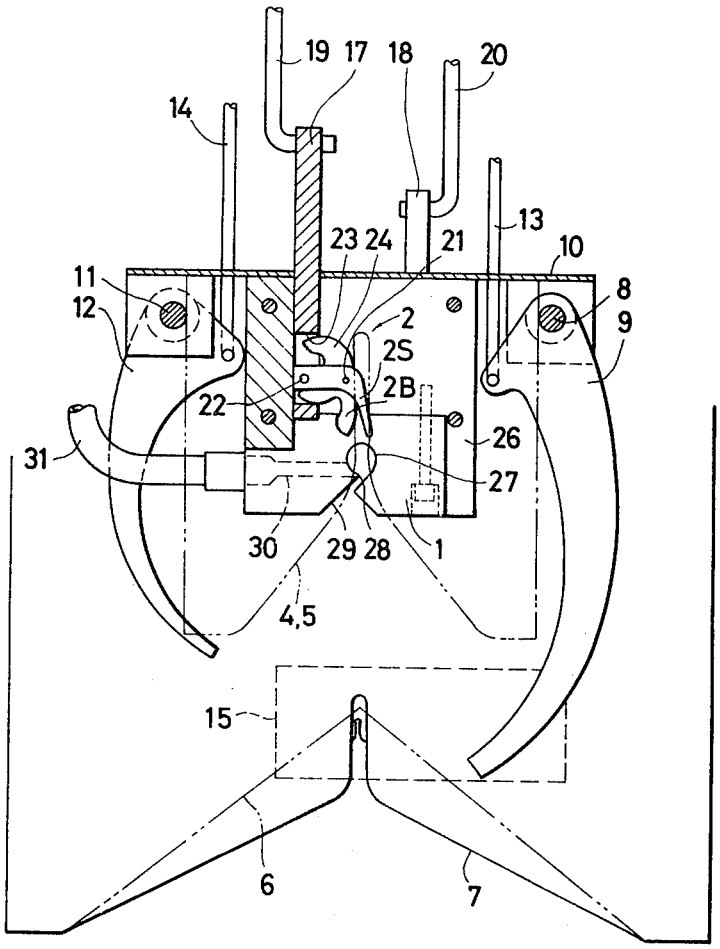
FIG. 2 is a view showing the section taken along line II—II in FIG. 1.

Since yarn guide plates 9*a* and 9*b* have a similar shape and also yarn guide plates 12*a* and 12*b* have a similar shape, in FIG. 2, they are representatively indicated by 9 and 12, respectively. Bill operating levers 17 and 18 are vertically moved through rods 19 and 20 by a knotter cam (not shown). The knotter bill operation will now be described in detail.

Each of the knotter bills 2 and 3 comprises a bill head 2H or 3H, a bill blade 2B or 3B and a bill spring 2S or 3S. The bill heads 2H and 3H and the bill springs 2S and 3S are fixed to each other through a screw 22 and a pin 21. The bill blades are arranged so that they turn with respect to the bill heads and bill springs through the pin 21.

A ]-shaped recess 23 is formed on each of the bill operating levers 17 and 18, and a vane portion 24 of the bill blade is fitted in the recess 23. Accordingly, in the embodiment illustrated in FIG. 2, if the operating levers 17 and 18 are moved in the vertical direction, the bill blades 2B and 3B turn with the pin 21 being as the fulcrum. In FIG. 2, there is illustrated the state where the knotter bills are opened. When the bill blade 2B is closed, the yarn is cut between the bill blade and bill spring, and the cut yarn ends are held between the bill blade and the bill head.

The nozzle 1 is fixed to a supporting piece 26 by a bolt 25. Reference numeral 27 represents a yarn inserting hole, and the hole 27 is connected to a V-shaped yarn inserting guide portion 29 located on the front face through a yarn inserting slit 28 extending in the tangential direction of the hole 27. A jet pipe 30 is connected to and opened within the hole 27 in a direction rectangular to the axial direction of the hole 27 and tangential to the hole 27. Compressed air from an air feed pipe 31 is jetted into the hole 27 through the jet pipe 30 to form a swirling air stream in the hole 27. The direction of communication to the hole 27 from the guide portion 29 of the yarn inserting slit 28 is set as the direction of the swirling air stream, whereby undesirable escape of the yarn from the hole 27 to the slit 28 at the time of formation of the air jet stream is prevented.

Figure 3:
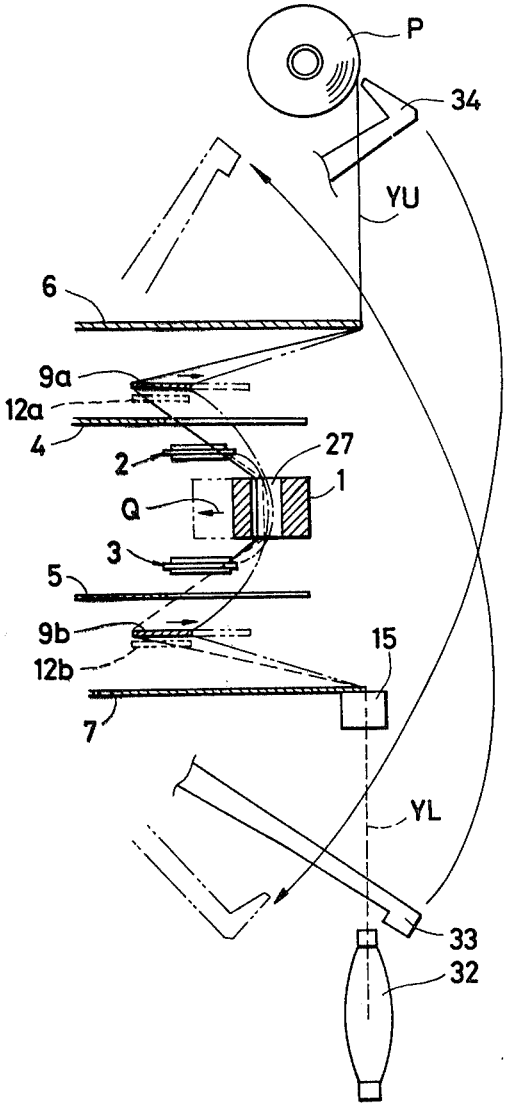
FIG. 3 is a side view partly in section showing the positional relationship of respective elements of the apparatus of FIG. 1.

The yarn guide plates, yarn pressers and knotter bills are arranged as shown in FIG. 3. The steps of the method of the present invention in the foregoing embodiment will now be described with reference to FIG. 3.

In the following description, a top yarn YU is derived from the pakage and while a bottom yarn YL is derived from the cop 32. The top and bottom yarns are travelled along slits formed at apexes of the V-shaped guide faces defined by the guide plates 4 and 5 and guide plates 6 and 7 are introduced into the hole 27 of the nozzle 1 and the knotter bills 2 and 3.

(A) A relay pipe 33 sucks and holds the yarn end of the cop 32 and turns to the position indicated by the chain line shown in FIG. 3 to insert the bottom yarn YL in the electronic slub catcher 15 and between the guide plates 6 and 7. In the actual operation, the yarn is inserted into the electronic slub catcher 15 just after splicing operation. However, insertion of the yarn into the slub catcher 15 is outside the scope of the invention, and therefore, this insertion operation is illustrated as above for convenience's sake in order to simplify the explanation.

(B) In the state where the knotter bill 2 is opened and the knotter bill 3 is closed, the yarn presser 12 is turned in the counterclockwise direction in FIG. 2 with the shaft 11 being as the fulcrum and is shifted to the position indicated by the dotted line in FIG. 3. Accordingly, the bottom yarn YL is introduced into the opened knotter bill 2 and the hole 27 of the nozzle 1 and is bent between the nozzle 1 and the yarn guide plate 7 as indicated by the dotted line in FIG. 3. At the subsequent step, the bottom yarn YL is changed over to the yarn presser 9*a* from the yarn presser 12*b*, and this state is illustrated in FIG. 3. At this point, however, the bottom yarn YL is bent by the yarn presser 12*b* located at the position indicated by the dotted line.

(C) A suction mouth 34 sucks and holds the yarn end of the package P and turns to the position indicated by the chain line to insert the top yarn YU between the guide plates 6 and 7.

(D) The bill blade 2B of the knotter bill 2 is closed to cut and hold the end of the bottom yarn.

(E) In the state where the knotter bill 2 is closed and the knotter bill 3 is opened, the yarn presser 9 is turned in the clockwise direction in FIG. 2 with the shaft 8 being as the fulcrum and is shifted to the position indicated by the solid line in FIG. 3. Accordingly, the top yarn YU is introduced into the opened knotter bill 3 and the hole 27 of the nozzle 1 and is bent between the nozzle 1 and yarn guide plate 6 as indicated by the solid line in FIG. 3.

(F) The bill blade 3B of the knotter bill 3 is closed to cut and hold the end of the top yarn.

(G) The yarn presser 12 is returned to the position shown in FIG. 2. At this point, the yarn indicated by the dotted line in FIG. 3 separates from the yarn presser 12*b* and is pressed by the yarn presser 9*b*.

When the foregoing steps (A) to (G) are completed, there is attained a positional relationship indicated by the solid and dotted lines in FIG. 3 between the top and bottom yarn. Namely, the top yarn YU is bent by the yarn presser 9*a* and the lower end thereof is held by the knotter bill 3, and the bottom yarn YL is bent by the yarn presser 9*b* and the upper end thereof is held by the knotter bill 2.

(H) In the above-mentioned state, the yarn pressers 9*a* and 9*b* are slightly retreated to the position indicated by the chain line in FIG. 3, and simultaneously, a changeover valve (not shown) is actuated to jet compressed air into the hole 27 from the jet pipe 30 to form a swirling air stream in the hole 27. Accordingly, this swirling air stream acts on the top and bottom yarns slightly slackened as indicated by the chain line in FIG. 3, whereby a high quality spliced or pieced up portion that cannot be obtained according to the conventional techniques can be conveniently formed.

The above slackening in the yarn is other than the slackening caused by elongation of the yarn per se and by the term "slackening" used herein is meant slackening sufficient to form a balloon by jetted air without formation of kinks in the spliced portion. In the foregoing embodiment, the swirling air stream is caused to act on the top and bottom yarns in the slackened state. It is possible to slacken the top and bottom yarn after subjecting them to the action of the swirling air stream, namely after initiation of air jetting. In short, the intended object of the present invention can be attained by slackening the top and bottom yarns under air jetting. Further, even if only one of the top and bottom yarns is slackened, there can be obtained a spliced portion better than knotted portions obtained according to the conventional techniques. When the yarns are slackened so that they are shifted to the position of the jet opening 30 in the hole 27 as indicated by symbols YU' and YL' in FIG. 4, a high power air jet just issued from the jet opening 30 impinges directly against the yarns YU' and YL' to promote entanglement of these yarns remarkably. As a result, a better spliced portion can be formed.

(I) After completion of the splicing step (H), the yarn presser 9 is returned to the position shown in FIG. 2, and the connected top and bottom yarns are wound on the package P by rotation thereof. In the ordinary state, the yarn is wound from the cop 32 onto the package P through the electronic slub catcher 15 and the yarn guide plates 7 and 6 while being traversed by a traverse device (not shown).

The above steps (A) to (I) are conducted continuously in succession, and the yarn knotting operation is completed.

A novel constitution of the spliced portion of spun yarns according to the present invention will be illustrated as follows.

Terms used in the instant specification will first be explained prior to detailed description of the constitution.

By the term "spun yarn" or "yarn" is meant a spun yarn formed by bundling so-called staple fibers obtained by cutting natural filaments such as those of cotton, wool and flax and chemical long filaments into short lengths or mixtures of these staple fibers, and chemical endless filamentary yarns are not included in the scope of "spun yarn". Further, it is defined that the "spun yarn" has an inherent twist number expressed in terms of the number of twists imparted at the spinning process per meter and these twists are distributed substantially uniformly along the entire length. A yarn comprising two or more of such "spun yarns" as structural units is included in the scope of the "spun yarn" irrespectively of the above-mentioned inherent twist number. By the term "variation of distribution of twists" is meant a phenomenon that the substantially uniform twist distribution inherent of a spun yarn is changed to a new twist distribution without substantial change of the inherent twist number of the spun yarn. More specifically, when doubled two spun yarns are twisted in one direction in a specific region, the twist number is increased on the side where this twisting direction is in agreement with the direction of the spun yarns but is decreased on the side where this twisting direction is reverse to the direction of the inherent twists of the spun yarns, and a new twist distribution is established in said specific region. In some case, the inherent twist distribution in the spun yarns is changed with the aid of expansion of the yarns. If a tension is then applied to the spliced portion except the limited specific region, the twists are shifted so as to compensate the variation of the twist distribution in the specific region caused by increase of the twist number, but the original inherent twist distribution cannot be completely restored. Namely, this variation given to the inherent twist distribution of the spun yarns by the above-mentioned change of the twist number in said specific region is called "variation of distribution of twists". By the term "the region of a spliced joint" is meant a portion where both the spun yarns are overlapped between the tips of end portions of both the yarns, and by the term "the tips of yarn end portions" of both the yarns are meant the tips of the breaked end portions of the spun yarns to be spliced, which have the same cut sectional area at the step of breakage even if the sectional area is decreased to some extent at the step of breakage because of release of single fibers from the restraint in the spun yarn on the change of distribution of twists because of the limit of the size of the single fibers.

The term "spliced joint" indicates the joining state of both the spun yarns. In the present invention, the state where after the above-mentioned partial forcible variation of substantially uniform distribution of twists of the spun yarns, a novel jointed condition resisting the original state-restoring action by inherent twists of the spun yarns or by binding of the spun yarns is established is called the "fixed" state. In other words, this "fixed" state cannot be lost at all by spontaneous shifting of strong twists toward the weak twist portion in one yarn for uniformalizing the twist distribution or the jointed state in the spun yarns. As will be apparent from the description given hereinafter, this "fixed" state includes the following embodiments.

(1) Wrapping fibers are entangling with the two spun yarns to be pieced up irrespectively of the position of the spliced joint.

(2) The two spun yarns are integrated into one yarn by twists in the same direction as the direction of inherent twists of the spun yarns and the respective spun yarns lose the independency. In this portion, the twist distribution or twist number is different from that inherent of the spun yarns.

(3) The two spun yarns are integrated into one yarn by twists in a direction reverse to the direction of twists inherent of the spun yarns. In this portion, the twist distribution or twist number is different from that inherent of the spun yarns.

(4) Both the spun yarns are integrated by twists in the same direction as the direction of twists inherent of the spun yarns to such an extent that the respective spun yarns lose the independency. In this portion, the twists are looser than the twists in the fixed portion in the above-mentioned embodiment (2).

(5) The spun yarns are combined by twists in a same direction as the direction of twists inherent of the spun yarns to such an extent that they are substantially separated in parallel to each other. In this portion, the twist distribution or twist number is different from that inherent of the spun yarns.

(6) The spun yarns are completely separated from each other but are twisted together by twists in a direction reverse to the direction of twists inherent of the spun yarns.

In general, the strength of such "fixed" state is expressed by the binding strength. In the present invention, however, it is specified that the critical lower limit of the strength of this "fixed" state is such that, for example, when the spliced joint of the present invention is automatically formed at the re-winding step of a cop having a slub catcher, the spliced joint in not disentangled by a tension customarily imposed on spun yarns during the winding movement (for example, 20 to 30 g in case of medium count yarns). Accordingly, in case of the knitting process, the critical lower limit is such that the spliced joint is not disentangled against the tension imposed on spun yarns and the actions of structural members of a knitting machine.

When it is tried to tie two spun yarns by arranging them in parallel and imparting twists thereto by fingers, no satisfactory joints can be obtained at all. As will readily be understood if actually tested, when two spun yarns are merely rotated together, only entanglement of fibers projecting from the surfaces of spun yarns is established and the binding strength is very low. Therefore, the two yarns are readily separated from each other and no satisfactory joint is formed. Since spun yarns are quite different from metal wires having no restoring capacity, the yarns tied by such simple rotation are readily separated from each other by the spontaneous restoring capacity thereof or by a tension externally imposed.

With the variation of the twist distribution, free end portions of fibers constituting spun yarns project externally and wrap the outer layers of the yarns if these free end portions are located in the region of the spliced joint (see reference symbol F described below). Even in the case where the tips of the end portions of both the yarns are held during formation of a spliced joint, they wrap the outer layers of the yarns in the region of the spliced joint at a position close to the holding point. As will be apparent from the principle diagram described hereinafter, also this wrapping is effective for fixation of the novel twist distribution by inhibiting the restoring action of separating the false-twisted yarns from each other according to a tension applied after formation of the spliced joint. Accordingly, it is noted that the fixed portion includes such wrapping. As pointed out hereinbefore, the spun yarn used in the present invention includes a doubled yarn or combined yarn. In this case, the variation of the twist distribution in the spun yarn as the structural unit is a main factor of such fixation. Accordingly, even the case where the spun yarns as structural units are arranged in parallel and the entire yarn has no inherent twist number may be included in the category of the fixation. Even in a yarn comprising a plurality of spun yarns as structural units and having an inherent twist number, not only the variation of the twist distribution in the entire yarn but also the variation of the twist destribution in each of the constituent spun yarns can be included in the scope of the fixation. Especially, in the latter case, the behavior of the wrapping fiber for fixation of binding of the constituent spun yarns, which is grasped as one variation of the twist distribution, and the variation of the twist distribution in the interior of each constituent spun yarn should be taken into consideration. Hereupon, it must be noted that it is unreasonable to consider that only a wrapping fiber is a factor of the fixation, or only a portion where first and second twists in the same direction are integrated to fix the changed twist distribution or where the changed twist distribution is fixed by second twists in a direction reverse to the direction of the first twists is a factor for fixing the spliced joint.

Various elements are deemed to make contributions to attainment of such variation of the twist distribution, but it is believed that the air pressure and air quantity are major factors. In case of spun yarns, a high air pressure causes a violent and drastic change of the twist distribution, and finally, the binding state among constituent fibers is disintegrated, resulting in yarn breakage. From this view point, spun yarns are distinguishable from filamentary yarns.

Five embodiments of the spliced joint of the present invention are illustrated in FIGS. 5 to 10. For producing these spliced joints, an air jet nozzle is commonly used in these embodiments. Both the yarns to be spliced are slackened before or during jetting of air. Of course, it is possible to slacken only one yarn according to the mode where a wound yarn having spliced joints of the present invention is actually used, but this embodiment is not illustrated in the drawing. Also in this case, a spliced joint having at least one fixed portion in the region of the spliced joint is included in the scope of the present invention. As specific examples of the embodiment where only one yarn is slackened, there can be mentioned a case where the cut end of only one yarn is held but the end of the other yarn is not held and a case where the yarn ends of both the yarns are held but only one yarn is slackened. Slackening imparted to both the yarn is necessary for generating a balloon when twists to be further imparted by the action of jetted air streams are accumulated between the yarn holding points and accumulation of such twists arrives at the point of saturation, and excessive slackening or too small slackening is not preferred in the present invention. When slackening is excessive, kinks are generated and these kniks are overlapped one another, and no good spliced joint can be obtained. When slackening is too small, it is difficult to impart twists to the yarn against the tension imposed on the yarn and cause a variation of the twist distribution in the yarn. This slackening may be defined as a slackening generated by elongation of fibers constituting the yarn or a larger slackening, but ordinarily, the slackening can be defined as a slackening sufficient to form a balloon having a maximum diameter equal to or larger than the inner diameter of the yarn inserting hole of the air jet nozzle and the definition will be substantially identical. The reason is that the quantity of slackening involves very practical problems described below. More specifically, the twisting shrinkage according to properties of the yarn, the contact or non-contact of the yarn with the wall face of the nozzle, the tension inhibiting generation of kinks, the decision of appropriate air pressure and quantity and the like must be taken into account, and these problems should be solved respectively. As means for generating such slackening, there can be mentioned, for example, movement of guide plates described hereinafter, shifting of the nozzle and a tension device for imparting such tension to yarns taken out by the jetting force of the nozzle that the yarns are balanced in the form of a balloon. Moreover, as pointed out hereinafter, it will readily be understood that this slackening increases chances of expansion of the yarn accompanied by formation of loops and enhances easiness in causing the above-mentioned variation of the twist distribution.

Five embodiments of the spliced joint shown in the drawing are obtained as a result of the difference of the state of slackening.

Figure 5:
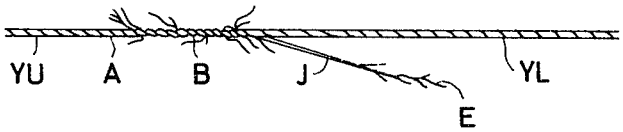
FIGS. 5, 6, 8, 9 and 10 are diagrams illustrating embodiments of the spliced joint of the present invention.

In the spliced yarn shown in FIG. 5, a yarn YU connected to a cop and a yarn YL connected to a package are held, and at first, the tips A and E of the yarn ends are in the free state and a spliced joint is formed. It is construed that yarns YU and YL are integrated with each other by the entangling action of fibers at the tips of the yarn ends or in the region of the spliced joint and a balloon is formed as a whole (if this phenomenon does not take place, the tips of the yarn ends escape outside the air nozzle). Then, variation of the twist distribution is caused. By the action of the first air jet stream, short fibers are separated and scattered from the tips of the yarn ends and in some case, they are entangled with the yarns YU and YL, but in principle, after the variation of the twist distribution, as the stably deformed fixed portion, there is formed a portion where the two yarns are twisted together by twists in the same direction as the direction of the twists inherent of the two spun yarns. However, this fixed portion B is short in the size and the size is very random, and the binding strength is lower than in other embodiments.

Further, since the tips of the yarn ends are not held, it is difficult to concentrate the variation of the twist distribution in the region of the spliced joint and control of the variation of the twist distribution is very difficult. Therefore, in this embodiment, the risk of generation of kinks is relatively large, and the variation of the twist distribution is very small. The reason is that in case of spun yarns, different from the case of filamentary yarns, it is not permissible to increase the air pressure excessively with a small quantity of air, because separation or scattering of fibers constituting the spun yarn is inevitably caused to occur and the yarn escapes outside from the nozzle region, rendering formation of a spliced joint difficult. Especially when both the yarn ends and the yarns are not held at all, formation of a spliced joint is very difficult, and the above-mentioned entanglement becomes excessive and the air stream jetted from the nozzle is rather used for formation of kinks while exerting no substantial action for causing a variation of the twist distribution. Incidentally, a wrapping fiber may be present in the portion A.

Figure 6:
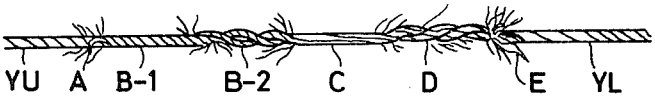
Figure 8:
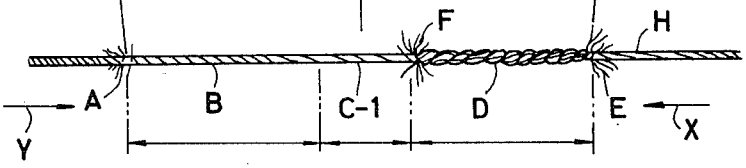
Figure 9:
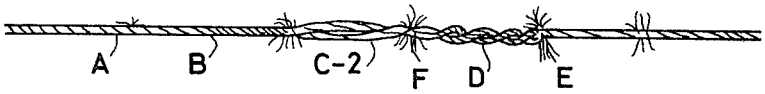
Figure 10:
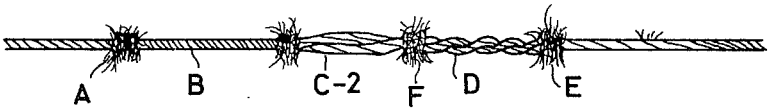

In the spliced yarn shown in FIG. 6, the yarn end tip A and yarn YU and the yarn end tip E and yarn YL are simultaneously held, and in this state, false twisting is attained in the two yarns by the air stream jetted in one direction. The fixed portion B of the spliced joint comprises a part B-1 where the two yarns are integrated into one yarn and a part B-2 where the two yarns are combined in the state separated into two yarns by second twists in the same direction as the direction of the twist inherent of the yarns. In the former part, the two yarns are twisted together and re-constructed as one spun yarn, and the independency of each of the spun yarns to be spliced is lost and in this integrated yarn, the twist number is different from the twist number inherent of the spun yarns. In the latter part, both the yarns are twisted together with twists looser than in the above-mentioned former part while retaining the independency of each spun yarn. A wrapping fiber is formed in the front and rear of the part B-2. In the subsequent portion of the spliced joint, the two spun yarns substantially lose the inherent twist distribution thereof and they are present in the state parllel to each other. Even in this state, the joint resists a disintegrating force by friction among fibers. The spliced joint further comprises a part in which the two spun yarns are twisted together by twists in a direction reverse to the direction of twists inherent of the spun yarns. This part D includes a twist distribution different from the twist distribution inherent of the spun yarns and has a wrapping fiber in the boundary to the part C and in the section E. When this spliced joint is compared with the spliced joint shown in FIG. 5, the region of the spliced joint can be specified very definitely, and therefore, the variation of the twist distribution can be made considerably great. However, as described hereinafter with respect to corresponding parts of the spliced joints shown in FIGS. 8 to 10, possibility of even slight escape of twists from the region of the spliced joint is restricted, and hence, the variation of the twist distribution in the region of the spliced joint becomes excessive. In each of the spliced joints shown in FIGS. 8 to 10, the tips A and E of the yarn ends are cut and held on one side and also the yarns YU and YL are held, and yarn bending guides are disposed between the point of holding the yarns YU and YL and the point of holding the tips of the yarn ends, and slackening is established by movement of the guides and air jet streams are applied to the spun yarns in this state. The embodiments of FIGS. 8 to 10 are in agreement with one another in these features. Further, these spliced joints commonly include a part B where the two spun yarns are integrated by twists in the same direction as the direction of the twists inherent of the spun yarns and the independency of each spun yarn is lost and a part D where the two spun yarns are twisted by twists in a direction reverse to the direction of the twists inherent of the spun yarns. In this point, these spliced joints are in agreement with the spliced joint of the embodiment shown in FIG. 6.

The spliced joint shown in FIG. 8 is different from the spliced joints shown in FIGS. 9 and 10 in the point that a section C-1 where the two spun yarns are integrated into one yarn by twists looser than the twists of the part B is formed adjacently to the part B in which the two spun yarns to be spliced are integrated into one yarn by twists in the same direction as the direction of the twists inherent of the spun yarns. In the section C-1, the twist number is smaller than the twist number inherent of the spun yarns. The spliced joint shown in FIG. 9 is in agreement with the spliced joint shown in FIG. 10 in the point that adjacently to the part B where the two spun yarns to be spliced are integrated into one yarn by twists in the same direction as the direction of the twists inherent of the spun yarns, there is formed a section C-2 in which the two yarns are separated substantially in parallel to each other and this section C-2 is substantially untwisted, but the spliced joints shown in FIGS. 9 and 10 are different from each other with respect to the quantity of the wrapping fiber at the parts A and E. Namely, in the spliced joint of FIG. 10, the amount of the wrapping fiber at the parts A and E is larger than in the spliced joint shown in FIG. 9. The wrapping fiber will now be described more in detail. In the spliced joint shown in FIG. 8, no wrapping fiber is present in the boundary between the part B and the section C-1, but in the spliced joints shown in FIGS. 4 and 5, the wrapping fiber is present in the boundary between the part B and the section C-2. Further, all the spliced joints shown in FIGS. 8 to 10 are in agreement with one another in the point that the wrapping fiber F is present in the boundary between the section C-1 or C-2 and the part D and the wrapping fiber is also present in the region of the spliced joint in the vicinity of the parts A and E, though these spliced joints are different from each other with respect to the quantity of the wrapping fiber.

It often happens that the wrapping fiber is hardly observed. It is considered that when the yarns are spliced together while they are held at the tips of the yarn ends, appearance of the wrapping fiber is remarkably influenced by the quantity of free fiber ends present in the region of the spliced joint. Further, the point to be wrapped by the wrapping fiber is considerably specified by the relation to the twist distribution, and it is considered that the number of wrapping fibers will be determined also relatively to the twist distribution. The winding direction of wrapping fibers present at a plurality of positions is the same as the direction of swirling air.

The spliced joint shown in FIG. 6 is different from the spliced joints shown in FIGS. 8 to 9 in whether or not there is observed in the vicinity of the tip E of the yarn end and outside the region of the spliced joint a portion H where the twist distribution inherent of the spun yarns is changed. In the illustration of FIG. 6 given hereinbefore, the expression "possibility of even slight escape of twists from the region of the spliced joint" is used in order to indicate this portion H.

More specifically, on formation of the spliced joint shown in FIG. 6, the two spun yarns are simultaneously held on both the sides of the region of the spliced joint, and therefore, the variation of the twist distribution in the region of the spliced joint has no influence on the yarns outside the region of the spliced portion. In contrast, in the spliced joints shown in FIGS. 8 to 9, on formation of the spliced point, top ends of the yarns to be pieced up are held by bills as described hereinafter, but since the yarn holding point or the twist stopping point is located outside the region of the spliced joint, if the jetted air stream is simultaneously applied to the two yarns, mutual entanglement or winding of the yarns is caused by the false twisting action in the region of the spliced joint between the yarn ends, but this winding does not expand beyond each yarn end. However, the influence of the variation of the twist distribution is given even to the yarns outside the region of the spliced joint. Especially, the yarns outside the region of the spliced joint on the side where the spun yarns are twisted by twists in a direction reverse to the direction of the twists inherent of the spun yarns are influenced so that the twists inherent of the spun yarns will be released. If the spontaneous restoring action of the spun yarns per se is relatively low, such influence is fixed as the variation of the twist distribution or re-construction of the fiber arrangement after formation of the spliced joint. In case of the yarns outside the region of the spliced joint on the side where the spun yarns are twisted by twists in the same direction as the direction of the twists inherent of the spun yarns, the above-mentioned influence acts in such a direction as will further increase the twist number. Accordingly, this influence can readily be compensated by the spontaneous restoring action of the spun yarns per se, and the variation of the twist distribution is hardly fixed but it cannot be said that the change of the twist distribution is not caused at all.

Incidentally, it is construed that when the twists thus imparted to the yarns outside the region of the spliced joint on the side where the spun yarns are twisted by twists in the same direction as the direction of the twists inherent of the spun yarns are spontaneously released after formation of the spliced joint, these twists being released have some influence on integration of the yarns in the part B and that twists imparted to the yarns outside the region of the spliced joint on the side where the spun yarns are twisted by twists in a direction reverse to the direction of the twists inherent of the spun yarns, namely twists imparted in such a direction as will release the inherent twists of the spun yarns, have some influence on formation of the part D when these twists are spontaneously released after formation of the spliced joint.

Spliced joints shown in FIGS. 5 to 10 are typical models formed by picking up common elements in various modifications, and a great number of modified spliced joints can be formed by changing such conditions as the air pressure, the air quantity, the inner diameter and dimension of the nozzle, the diameter of the jetting hole of the nozzle and the jetting frequency in the nozzle. In the drawing, only wrapping yarns wound on yarns at right angles to the axial line of the yarn are illustrated. Practically, a number of wrapping fibers wound on the yarns at random angles are seen in the portions B and D. Further, according to splicing conditions, it sometimes happens that in the portions B and D, the diameter is larger than the inherent diameter of the spun yarn and an expanded area is formed.

Figure 7:
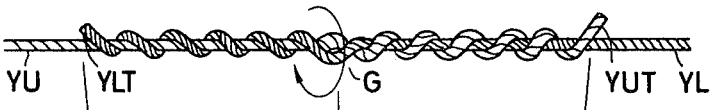
FIG. 7 is a view illustrating the principle of formation of the spliced joint.

FIG. 7 is a diagram illustrating the principle of forming the spliced portion of the present invention. In order to distinguish the two yarns YU and YL definitely from each other, they are drawn so that they are different to some extent with respect to the twist quantity, but actually, these yarns have the same appearance. Yarns per se are Z-twisted. YLT and YUT represent ends of the yarns YL and YU, respectively. The swirling air stream is applied to the center of the yarn in a direction indicated by an arrow in the drawing so that the spliced portion is formed. A secondary Z-twist if formed on the left side of the acting point G of the swirling air stream and secondary S-twist is formed on the right side of the acting point G. The loosely twisted parts C-1 and C-2 are also formed at positions where the swirling air stream acts.

A surface wrapping fiber F is formed not only in the yarn end portions A and E but also in the boundary portion D between the parts C-1 and C-2. It is construed that such surface wrapping fiber portion F acts effectively for increasing the strength of the spliced joint.

In the portion B, since the so called first and secondary twists are of the same direction, constituent fibers of the yarns are intimately and densely entagled with one another and the two yarns are integrated into one yarn where the presence of the two yarns cannot be recognized. Accordingly, in this portion, the yarn strength is very high and the knot size is less than 2 times the yarn size. However, in the portion D on the right side of the acting point, since the directions of the first and secondary twists are reverse to each other, the yarns are completely separated as if in the form of a rope, and both the yarns are loosely twisted by S-twists. Namely, on the left side of the acting point G, the yarn strength is high, but on the right side of the acting point G, the yarn strength is low.

According to the present invention, when the wound yarn is used at the final step such as the knitting or weaving step the direction of drawing the yarn is set as the direction X in FIG. 8, and air jetting by the air nozzle is performed so that the above weak spliced portion appears in the rear and the above strong spliced portion appears in the front, whereby the practical yarn strength of the spliced portions is made equal to the strength of the strong spliced portion. By this arrangement, a novel spliced joint having a better quality than a knotted portion formed by a conventional mechanical knotter such as a Weaver's knotter or Fisherman's knotter can be obtained according to the present invention.

The operation of drawing the yarn in the direction X results in the operation of squeezing the yarn in the direction Y. However, since two yarns are closely entangled in the yarn end portion A, B on the left side in FIG. 8 they cannot be distinguished from each other, said yarn end portion is hardly caught by a knitting or weaving member and if it is higher than that of the yarn end portion D, it can resist the squeezing action. Further, since no squeezing action is imposed on the yarn end portion D having a low tenacity, it is not cut or broken. Therefore, the strength by entanglement of the yarns acts directly as the strength of the spliced joint. The size of the knot formed by the above-mentioned conventional mechanical knotter such as Weaver's knotter or Fisherman's knotter is about 3 times the yarn size, and therefore, the knot is readily caught by a knitting or weaving member and yarn breakages are often caused. Further, the strength of the knot at the actual knitting or weaving step is much lower than the strength of the knot when the yarn is statically drawn from both the ends.

However, when the yarn is drawn in the direction Y, the yarn is squeezed in the direction X, and at this point, the yarn end portion D is squeezed in a direction opposite to the direction of entanglement of monofilaments in the yarn end portion D. Accordingly, the yarn is readily caught by a knitting or weaving member. When the yarn is caught by a knitting or weaving member, the tension is imposed on the front portion which has actually passed through the knitting or weaving member, rather than on the portion actually caught by the knitting or weaving member.

This fact will now be described specifically by reference to FIG. 8.

When the yarn is drawn in the direction X, the tension by catching or contact is imposed on the left side of the point of contact with the knitting or weaving member and when the yarn is drawn in the direction Y, the tension by catching or contact is imposed on the right side of the point of contact with the knitting or weaving member.

On the right side of the acting point G, since a twist is given in a direction releasing the twist on the yarn per se. Accordingly, a loosely twisted portion having a lower twist than the ordinary portion of the yarn is formed on the right side H of the yarn end portion E. The tenacity is lowest in this loosely twisted portion H. When the yarn is drawn in the direction Y, the tension caused by the contact resistance of the spliced portion is imposed on said loosely twisted portion H and yarn breakage is readily caused in this portion H. It is quite natural that when the two yarns separate from each other in the portion D as mentioned above and the catching resistance is increased, yarn breakage should readily be caused in the portion H.

In contrast, when the yarn is drawn in the direction X, since the two yarns are closely and intimately entangled with each other in the yarn end portion B to form substantially one yarn, the resistance of contact with a knitting or weaving member is low and on the left side of the yarn end portion B there can be retained a yarn tenacity sufficient to cope with said contact resistance, and after passage of the yarn end portion B, any particular contact releasing the entanglement of filaments is not caused. Accordingly, the contact resistance is very low and of no significance.

As will be apparent from the foregoing illustration, according to the present invention, in connection with twists generated on both the sides of the swirling air stream, in directions opposite to each other, the swirling direction of the swirling air stream is decided so that with respect to the direction of drawing the yarn at the final step such as the knitting or weaving step for forming a knitted or woven fabric, a twist of the same direction as that of the twist on the yarn per se is formed in front of the acting point of the swirling air stream and a twist of a direction opposite to the direction of the twist on the yarn per se is formed in rear of the acting point of the swirling air stream. By virtue of this characteristic feature, a wound yarn for the final step, which has knots hardly causing yarn breakages, can be obtained, and reduction of the operation efficiency at the knitting or weaving step owing to yarn breakage can be remarkably prevented. From the experiments, it has been confirmed that according to the present invention, the frequency of occurrence of breakages of spliced joints at the knitting step can be reduced to about 1/10 of said frequency in case of the conventional mechanical knotter.

Figure 4:
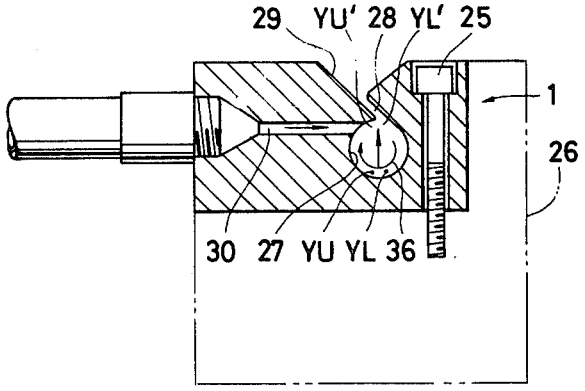
FIG. 4 is a sectional view illustrating one embodiment of the air nozzle.

Another embodiment of the present invention will now be described in detail by reference to FIGS. 4 and 11.

Figure 11:
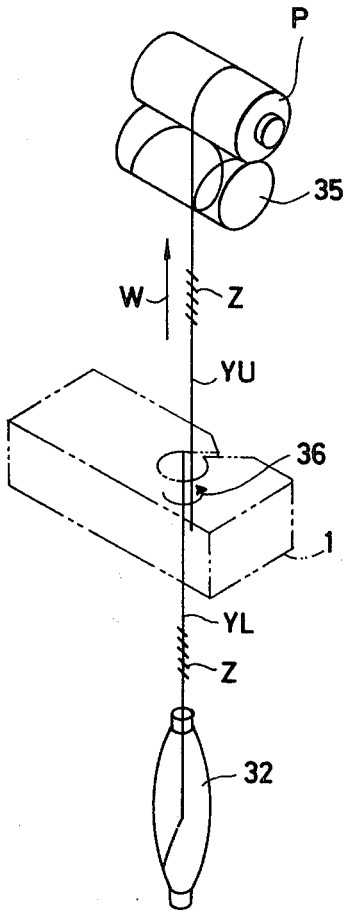
FIG. 11 is a diagram illustrating the outline structure of a winder in practising another method of the present invention.

FIG. 11 is a view illustrating diagrammatically the structure of an automatic winder. A yarn taken out from a cop 32 is checked as to whether or not it is a good yarn. A good yarn is wound on a package P driven by a traverse drum 35. The direction of movement of the yarn at this winding step is indicated by reference symbol W. As the winder, there is employed a known winder comprising known members such as a tension device, a slub catcher, a suction nozzle for taking out a yarn from a cop and a suction nozzle for taking out a yarn from a package. Since these members are irrelevant to the characteristic feature of the present invention, detailed description of these member is omitted. Reference numeral 1 represents an air nozzle for knotting yarns which have been judged as having inferior portions at the winding step including a slub catcher and thus been cut. In the air nozzle 1, an air jet pipe 30 is opened to a yarn inserting hole 27 in the tangential direction, and a swirling air stream 36 is formed in the yarn inserting hole 27 by air jetted from the jet pipe 30. When yarns are Z-twisted, if the package P is used at the knitting or weaving step directly as a yarn feed package, a bottom yarn YL taken out from the cop 32 and a top yarn YU taken out from the package P are doubled and inserted into the yarn inserting hole 27 of the nozzle. Then, the swirling air stream 36 is caused to act on the doubled portion in a direction indicated by an arrow in FIG. 7. In this case, the yarn end portion B shown in FIGS. 8–10 is formed in upside of the air nozzle 1 in FIG. 11.

If a yarn is wound on a package to obtain a feed package, for knitting or weaving step the air nozzle 1 is so constructed that the swirling air stream is caused to act on the doubled portion in a direction reverse to the above-mentioned direction. Then, an air nozzle which has a reverse structure to that shown in FIG. 11 may be applied. In this case, the yarn end portion B shown in FIG. 8 is formed lowerside of the air nozzle 1 in FIG. 11.

When knots formed by the conventional Fisherman's knotter and Weaver's knotter are compared with the spliced joint formed by the present invention, it is found that in case of the Fisherman's knotter, the knot size ratio to the yarn size is 3.6 and 30 yarn breakages take place per 1000 knots at the knitting step and in case of the Weaver's knotter, the knot size ratio to the yarn size is 3 and 3 yarn breakages take place per 1000 knots at the knitting step, whereas in case of the present invention, the spliced joint size ratio to the yarn size is 2 at highest and 0.3 yarn breakage take place per 1000 spliced joints at the knitting step. Thus, in the present invention, the frequency of occurrence of yarn breakages at the knitting step is reduced to less than 1/10 as compared with the frequency of occurrence of yarn breakages in the conventional knotters.

As an example, the spliced spun yarn having a good quality and being adequate to practical use is obtained according to the present invention under the following condition.

processed spun yarn: mixed yarn of polyester-wool.
yarn count Nm 41.
winding tension of winder: 13 g.
pressure of air nozzle: 5.5 kg/cm$^2$.
flow of nozzle: 5.6/sec.
time of applying jet: 0.4 sec.

In the present invention, as shown in FIG. 3, when the yarns are slackened, arcs indicated by the chain line are formed in the yarns. It is believed that formation of such arcs is one of causes of production of a good spliced portion in the present invention.

More specifically, when such arcs are formed in the yarns, ends of constituent fibers of the yarns readily separate and project from the yarns, and these projecting fibers exert effects of binding and entangling the ends of both the yarns with each other tightly. Moreover, because of the presence of such arcs, rotation of the yarns is allowed only in a very narrow region in close proximity of the acting point of the swirling air stream, and therefore, a strong twisting action is locally imposed on the yarn ends and a sufficiently entangled spliced portion can be obtained. In order to form good arcs, it is preferred that the yarn catching portions of the knotter bills 2 and 3 be located at positions deviated slightly from the central line of the hole 27 of the nozzle 1 as shown in FIG. 3.

In practising the method of the present invention, there may be adopted a modification in which at the step (H), the yarn presser 9 is set at a fixed position and the nozzle 1 is swing with one shaft being as the fulcrum or moved along a guide shaft so that it is shifted in a direction of arrow.

In the foregoing illustration, only the yarn ends are grasped by the bills 2 and 3 and other portions are merely pressed by the yarn pressers 9*a* and 9*b*. A spliced joint formed when in the portions of the yarn pressers 9*a* and 9*b*, the yarns are grasped by other bills or between levers and a swirling air stream is caused to act on the slacked doubled portion is illustrated in FIG. 6.

When the yarn pressers 9*a* and 9*b* are replaced by bills or the like for clamping the yarns, the portions of the bills 2 and 3, namely the yarn end portions, are set free and a swirling air stream is caused to act in this state, a spliced joint as shown in FIG. 5 is obtained.

And further, air suction means may be applied to hold the cut yarn ends instead of the yarn catching members of the knotter bills 2 and 3.

Methods for forming spliced joints of the present invention have been described, but it must be noted that these methods are shown only for illustration and the present invention is not limited by these methods at all.

What is claimed is:

1. A yarn splicing method using an air nozzle knotter, characterized in that two spun yarns of which one end is introduced into a yarn inserting hole of the air nozzle knotter from one end thereof and another end is introduced into the hole from the other end thereof are arranged, and then at least one of said spun yarns is slightly slackened prior to or simultaneously with jetting of air into the spun yarns by moving a yarn presser for pressing the yarn into the yarn inserting hole and wherein the each end of the spun yarn is held at both sides of the air nozzle knotter respectively before applying jetting of air to the spun yarns.

2. A yarn splicing method as set forth in claim 1 wherein slackening of the yarn is performed by moving the air nozzle.

3. A yarn splicing method as set forth in claim 1 wherein in connection with twists generated on both the sides of the air nozzle knotter in directions opposite to each other, the direction of the swirling air stream within said air nozzle knotter is decided so that with respect to the direction of drawing the yarn at the final step such as the weaving or knitting step, a twist of the same direction as that of the twist on the yarn per se is formed in front of the acting point of the swirling air stream and a twist of a direction opposite to the direction of the twist on the yarn per se is formed in rear of the acting point of the swirling air stream.

4. A spliced joint of spun yarns, characterized in that distribution of twist inherent of spun yarns is changed in the region of a spliced joint by a twisting action imparted simultaneously to the spun yarns by means of an air jet nozzle and at least one fixed portion where thus generated another distribution of twists is fixed is included in the spliced joint which includes in the fixed portion a wrapping fiber in the vicinity of the ends of both yarns within the region of the spliced joint.

5. A spliced joint of spun yarns as set forth in claim 4, wherein the fixed portion of the new twist distribution comprises a part where the two spun yarns are twisted by twists in the same direction as the direction of the twists inherent of the spun yarns and a part where two spun yarns are twisted by twists in a direction reverse to the direction of the twists inherent of the spun yarn.

6. A spliced joint of spun yarns characterized in that distribution of twist inherent of spun yarns is changed in the region of a spliced joint by a twisting action imparted simultaneously to the spun yarns by means of an air jet nozzle and at least one fixed portion where thus generated another distribution of twists is fixed is included in the spliced joint and which includes as the fixed portion a wrapping fiber in the boundary between the part where the two spun yarns are twisted by twists in the same direction as the direction of the twists inherent of the spun yarns and the part where the two spun yarns are twisted by twists in a direction reverse to the direction of the twists inherent of the spun yarns.

7. A spliced joint of spun yarns as set forth in claim 6, wherein the fixed portion of the new twist distribution comprises a part where the two spun yarns are twisted by twists in the same direction as the direction of the twists inherent of the spun yarns and a part where two spun yarns are twisted by twists in a direction reverse to the direction of the twists inherent of the spun yarn.

8. A spliced joint of spun yarns characterized in that distribution of twist inherent of spun yarns is changed in the region of a spliced joint by a twisting action imparted simultaneously to the spun yarns by means of an air jet nozzle and at least one fixed portion where thus generated another distribution of twists is fixed is included in the spliced joint wherein the fixed portion of the new twist distribution comprises a part where the two spun yarns are twisted by twists in the same direction as the direction of the twists inherent of the spun yarns and a part where two spun yarns are twisted by twists in a direction reverse to the direction of twists inherent of the spun yarn, said part of the fixed portion of the new twist distribution where the two spun yarns are twisted by twists in the same direction as the direction of the twist inherent of the spun yarns comprising a section where the two spun yarns are integrated into one yarn by twists in the same direction as the direction of the twists inherent of the spun yarns and a section where the two spun yarns are integrated into one yarn by twists looser than the twists of the first mentioned section and including as the fixed portion of the spun yarns a wrapping yarn in the vicinity of the ends of both the yarns within the region of the spliced joint and further including a wrapping fiber in the boundary between the part where the two spun yarns are integrated into one yarn by the looser twists and the part where two spun yarns are twisted by twists in a direction reverse to the direction of the twists inherent of the spun yarns.

9. A spliced joint of spun yarns characterized in that distribution of twist inherent of spun yarns is changed in the region of a spliced joint by a twisting action imparted simultaneously to the spun yarns by means of an air jet nozzle and at least one fixed portion where thus generated another distribution of twists is fixed is included in the spliced joint wherein the fixed portion of the new twist distribution comprises a part where the two spun yarns are twisted by twists in the same direction as the direction of the twists inherent of the spun yarns and a part where two spun yarns are twisted by twists in a direction reverse to the direction of twists inherent of the spun yarn, said part of the fixed portion of the new twist distribution where the two spun yarns are twisted by twists in the same direction as the direction of the twists inherent of the spun yarns comprising a section where the two spun yarns are integrated into the one yarn by twists in the same direction as the direction of the twists inherent of the spun yarns and a section where the two spun yarns are substantially separated in parallel to each other, and including in the fixed portion a wrapping yarn in the vicinity of the ends of both the yarns within the region of the spliced joint and further including a wrapping fiber in the front and rear of the section where the two spun yarns are substantially separated in parallel to each other.

10. A spliced joint of spun yarns characterized in that distribution of twist inherent of spun yarns is changed in the region of a spliced joint by a twisting action imparted simultaneously to the spun yarns by means of an air jet nozzle and at least one fixed portion where thus generated another distribution of twists is fixed is included in the spliced joint wherein the fixed portion of the new twist distribution comprises a part where the two spun yarns are twisted by twists in the same direction as the direction of the twists inherent of the spun yarns and a part where two spun yarns are twisted by twists in a direction reverse to the direction of twists inherent of the spun yarn, said part of the fixed portion of the new twist distribution where the two spun yarns are twisted by twists in the same direction as the direction of the twists inherent of the spun yarns comprise a section where the two spun yarns are integrated into one yarn by twists in the same direction as the direction of the twists inherent of the spun yarn and a section where the two spun yarns are twisted into one yarn by twists looser than the twists of the first mentioned section, and said part further includes a section where the two spun yarns are present in the state parallel to each other and a section where the two spun yarns are separated and twisted by twists in a direction reverse to the direction of the twists inherent of the spun yarns including in the fixed portion a wrapping fiber in the vicinity of both the yarns within the region of the spliced joint and further comprising a wrapping fiber in the front and rear of the section where the two spun yarns are present in the state parallel to each other.

* * * * *